US008618994B1

(12) United States Patent
Harris et al.

(10) Patent No.: US 8,618,994 B1
(45) Date of Patent: Dec. 31, 2013

(54) PASSIVE ELECTROMAGNETIC POLARIZATION SHIFTER WITH DIELECTRIC SLOTS

(75) Inventors: Daniel W. Harris, Mount Laurel, NJ (US); Vladimir Volman, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 264 days.

(21) Appl. No.: 13/025,333

(22) Filed: Feb. 11, 2011

Related U.S. Application Data

(63) Continuation-in-part of application No. 12/729,385, filed on Mar. 23, 2010.

(51) Int. Cl.
*H01Q 19/00* (2006.01)
*H01Q 15/02* (2006.01)

(52) U.S. Cl.
USPC ..... 343/756; 343/909; 343/911 R

(58) Field of Classification Search
USPC ..... 343/756, 753, 909
See application file for complete search history.

(56) References Cited

U.S. PATENT DOCUMENTS

| | | | | |
|---|---|---|---|---|
| 2,577,619 | A | | 12/1951 | Kock |
| 2,887,684 | A | | 5/1959 | Dexter et al. |
| 4,342,034 | A | | 7/1982 | Monser |
| 4,551,692 | A | | 11/1985 | Smith |
| 4,889,402 | A | * | 12/1989 | Reinhart ..... 385/2 |
| 5,045,639 | A | * | 9/1991 | Liu et al. ..... 174/524 |
| 5,254,447 | A | * | 10/1993 | Meyer et al. ..... 430/510 |
| 5,845,391 | A | * | 12/1998 | Bellus et al. ..... 29/600 |
| 6,014,115 | A | * | 1/2000 | Ghaby et al. ..... 343/909 |
| 6,163,957 | A | * | 12/2000 | Jiang et al. ..... 29/852 |
| 7,014,727 | B2 | * | 3/2006 | Wargo et al. ..... 156/247 |
| 7,564,419 | B1 | | 7/2009 | Patel |
| 2005/0006335 | A1 | * | 1/2005 | Wargo et al. ..... 216/18 |
| 2008/0165068 | A1 | * | 7/2008 | Caswell ..... 343/753 |

OTHER PUBLICATIONS

Arlon, Inc. brochure for AD410 Laminate, "PTFE/Woven Fiberglass/Micro-Ceramic Filled Laminate for RF & Microwave Printed Circuit Boards", 2006 Arlon Incorporated.
Arlon Inc. brochure for AD1000 Laminate, "PTFE/Woven Fiberglass/Ceramic Filled Laminate for Microwave Printed Circuit Boards", 2008, 2009, 2010 Arlon Incorporated.

* cited by examiner

*Primary Examiner* — Jerome Jackson, Jr.
*Assistant Examiner* — Ricardo Magallanes
(74) *Attorney, Agent, or Firm* — Howard IP Law Group, PC

(57) ABSTRACT

A method for making a dielectric-slot polarizer includes affixing plural dielectric sheets in a stack with those sheets having the greatest dielectric constant toward the center of the stack. The dielectric sheets may be fused or joined to each other by heat, pressure, or both. A dielectric support sheet is affixed by adhesive to a first side of the stack to form a partially supported stack. Slots are defined through the partially supported stack down to the adhesive. A second dielectric support sheet is adhesively affixed over the slots of the stack to define the polarizer.

12 Claims, 9 Drawing Sheets

PASSIVE ELECTROMAGNETIC POLARIZATION SHIFTER WITH DIELECTRIC SLOTS

CROSS-REFERENCE TO RELATED APPLICATIONS

This is a continuation-in-part of non-provisional application Ser. No. 12/729,385, filed Mar. 23, 2010 in the names of Volman and Harris.

BACKGROUND

The electromagnetic energy or "waves" transduced by an antenna to or from free space is or are characterized by "polarization." The free-space form of electromagnetic energy is "elliptically" polarized. Special forms of elliptical polarization are termed "linear" or "circular" polarization. In linear polarization, the electric field (E) vector of the radiation remains fixed at a particular orientation relative to the environment over a complete cycle of the electromagnetic wave. The elliptical polarization can be consider as superposition of two mutual orthogonal components of linear polarization simultaneously coexisting and having generally different magnitudes and phase shifts. These two components are often referred to as "Vertical" (V) or "Horizontal," (H) regardless of the actual orientation of the electric field vector relative to local vertical or horizontal. A special form of elliptical polarization is termed "circular" polarization and formed if these two mutual orthogonal linear components have equal magnitude and ±90° shift. In circular polarization, the electric field vector rotates about the direction of propagation once during each cycle of the electromagnetic wave, so that its projection onto a plane appears to "rotate." The direction of rotation of the electric field vector defines the left or right "hand" of circularity and is defined by the sign of the 90-degree phase shift. The antenna designer will ordinarily design his antenna to respond to either one (V or H) linear or to both simultaneously.

U.S. Pat. No. 4,551,692, issued Nov. 5, 1985 in the name of Smith indicates that radar systems presently used frequently employ polarized microwave radiation for surveillance and to detect and track selected target objects. Such radar systems are subject to considerable undesired signal return from raindrops, causing clutter which tends to obscure the desired signals. This effect is particularly pronounced in the millimeter wavelength region because the dimensions of raindrops are approximately equal to the wavelength of the radiation. When circularly polarized microwave radiation is transmitted, the raindrops reflect an opposite sense of the transmitted circular polarization, which is then rejected by the radar antenna and specialized circuitry. The target reflects in the same sense of circular polarization as that transmitted, thereby permitting its direct observation unobscured by rain clutter. The forms of polarized microwave radiation most conveniently generated according to the design of radar antennas and feeds are linear forms of polarization. This has motivated the development of polarizer or phase shifting gratings effective for transforming linearly polarized microwave radiation to a circular form, and for transforming the return signal back to linear form upon return from a target region.

U.S. Pat. No. 7,564,419, issued Jul. 21, 2009 in the name of Patel describes a composite polarizer including a first polarizer having a plurality of metal vanes and also including a second polarizer having a plurality of parallel layers of dielectric material. The first and second polarizers are disposed along an axis and provide differential phase shifts at frequencies f1 and f2. A total of the first differential phase shifts is about 90°, and a total of the second differential phase shifts is also about 90°. The result is that relative rotation of the polarizers allows linear polarization to pass, or allowing conversion of between linear and elliptical polarization and selection of right- or left-handedness for elliptical and circular polarization. The main problem of all polarizers with metal inclusions (vanes, meander lines, etc.) at millimeter-wave frequencies or higher is high Ohmic loss caused by strong skin effect.

Improved or alternative polarizers and fabrication techniques are desired.

SUMMARY

A method for fabricating a dielectric polarizer or phase shifter comprises the steps of sandwiching a sheet of dielectric material exhibiting a first dielectric constant between a pair of sheets of dielectric material exhibiting a second dielectric constant, different from the first dielectric constant, to form a monolithic stack defining first and second surfaces, and sandwiching a first adhesive preform between a first dielectric support sheet and the first surface of the monolithic stack, to form a partially supported stack. Slots, grooves or groove-like depressions are defined in the second surface of the partially supported stack, nominally to the depth of the first adhesive preform, and a second adhesive preform is sandwiched between a second dielectric support sheet and the slotted or grooved second surface of the partially supported stack to define a fully supported stack. In a mode of the method, the first and second adhesives are cured or allowed to cure. The sheet of dielectric material exhibiting the first dielectric constant may be joined with the pair of sheets of dielectric material exhibiting a second dielectric constant, different from the first dielectric constant, and the joining may be performed by fusion bonding the sheets by heat, pressure, or both. The defining step may be performed so that the slots, grooves or groove-like depressions are parallel to one another.

A method for making a phase shifter for electromagnetic energy may comprise the step of stacking a plurality of generally planar dielectric sheets to produce a stack of dielectric sheets, with those dielectric sheets toward the center of the stack being selected to have a greater dielectric constant than those dielectric sheets toward the outside of the stack to form a unitary stack structure defining first and second sides. A layer of adhesive may be applied to a first side of a first dielectric support sheet, and may be affixed to the first side of the unitary stack structure. In a mode of this method, slots, grooves or groove-like depressions are defined in the second surface of the partially supported stack, nominally to the depth of the first adhesive perform. A layer of adhesive is applied to a first side of a second dielectric support sheet, and the adhesive on the first side of the second support sheet is affixed to the second side of the partially supported stack having the slots, grooves or groove-like depressions. The adhesive may be cured or allowed to cure. The application of a layer of adhesive to the first side of one of the first and second dielectric support sheets may include the steps of generating an adhesive preform and applying the adhesive preform to the first side of the one of the first and second dielectric support sheet. The step of generating an adhesive perform may include the steps of cutting a sheet of uncured epoxy to the dimension of one of the first dielectric support sheet, the second dielectric support sheet, and the stack of dielectric sheets. This method may further comprise the step of joining the mutually adjacent surfaces of the stack of dielectric sheets to form a unitary stack structure defining first and second sides, and the joining may be performed by fusion bonding the stack of dielectric sheets by heat, pressure, or both. The defining step may be performed so that the slots, grooves or groove-like depressions are mutually parallel.

BRIEF DESCRIPTION OF THE DRAWING

FIGS. 6A through 6K together illustrate a method for making a polarizer or phase shifter according to an aspect of the disclosure;

DETAILED DESCRIPTION

Figure 1A:
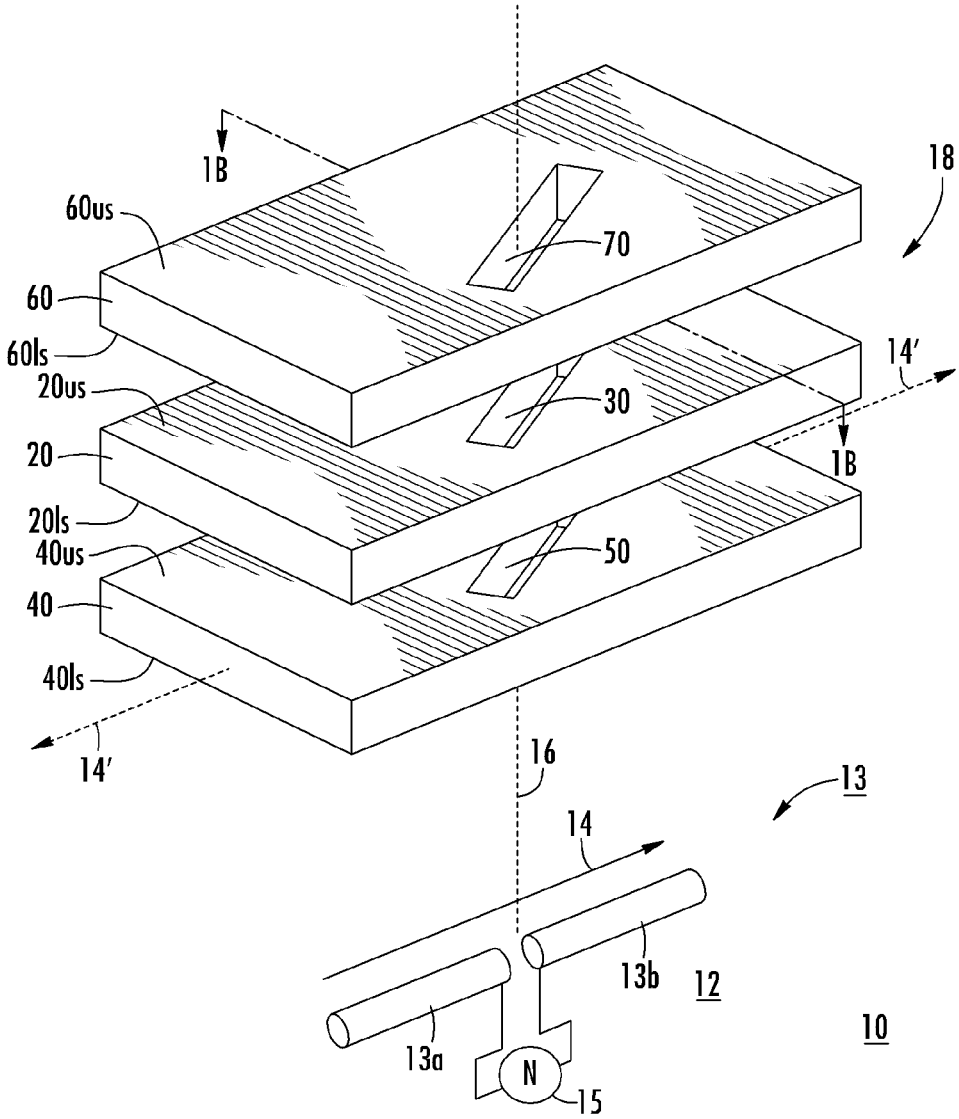
FIG. 1A is a simplified perspective or isometric view of an elliptically polarized source including a linear electromagnetic signal source together with a polarization shifter as described in U.S. patent application Ser. No. 12/729,385, filed Mar. 21, 2010 in the name of Volman et al.

In FIG. 1A, a device 10 of elliptical or nominally circular polarization according to an exemplary embodiment, includes a source 12 of linearly polarized radiation, represented by a notional electric field vector 14. For the sake of simplicity, linear polarized source 12 is shown as a dipole 13 with first and second mutually coaxial conductors 13*a* and 13*b*, the feed end of which dipole is connected to a source 15 of electrical oscillation. As known, the vector of electrical field 14 propagates away from source 12 as a perpendicular to a line 16.

Also in FIG. 1A, a stack 18 of dielectric slabs 20, 40, and 60 is illustrated, exploded to reveal certain details. Dielectric slab 20 includes a generally planar upper surface 20*us* and a generally planar lower surface 201*s*. Similarly, dielectric slab 40 includes a generally planar upper surface 40*us* and a generally planar lower surface 401*s*, and dielectric slab 60 includes a generally planar upper surface 60*us* and a generally planar lower surface 601*s*. The dielectric slabs 20, 40, and 60 are disposed with their upper and lower surfaces mutually parallel, and with their upper and lower surfaces intercepting or intercepted by propagation path or line 16. While the dielectric slabs of FIG. 1A are illustrated as exploded away from each other, those skilled in the art will understand that the upper surface 20*us* of dielectric slab 20 is juxtaposed with the lower surface 601*s* of dielectric slab 60, and the lower surface 201*s* of dielectric slab 20 is juxtaposed with the upper surface 40*us* of dielectric slab 40 (not by definition, can be additional slabs to improve matching). The rectangular shape of the dielectric sheets is not significant.

As illustrated in FIG. 1A, each of dielectric slabs 20, 40, and 60 of stack 18 defines a through aperture or slot 30, 50, and 70, respectively. More particularly, pierced dielectric slab 20 defines a slot 30 extending from upper surface 20*us* to lower surface 201*s*, dielectric slab 40 defines a slot 50 extending from upper surface 40*us* to lower surface 401*s*, and dielectric slab 60 defines a slot 70 extending from upper surface 60*us* to lower surface 601*s*. Slots 30, 50, and 70 are mutually registered, which makes the stack of dielectric sheets into a polarizer or phase shifter. In FIG. 1A, the projection of the linear polarization vector 14 is illustrated by the dash line 14'.

In stack 18 of FIG. 1A, pierced dielectric slab 40 lies between pierced dielectric slab 20 and linear source 12, and pierced dielectric slab 60 is remote from source 12 and from dielectric slab 40 relative to slab 20. In FIG. 1A, dielectric slab 20 is a "polarizer" slab or "main" polarizer slab, and dielectric slabs 40 and 60 are "matching" slabs, which also provide some degree of polarizing, so slabs 40 and 60 may be termed "matching/polarizing" slabs.

Figure 1B:
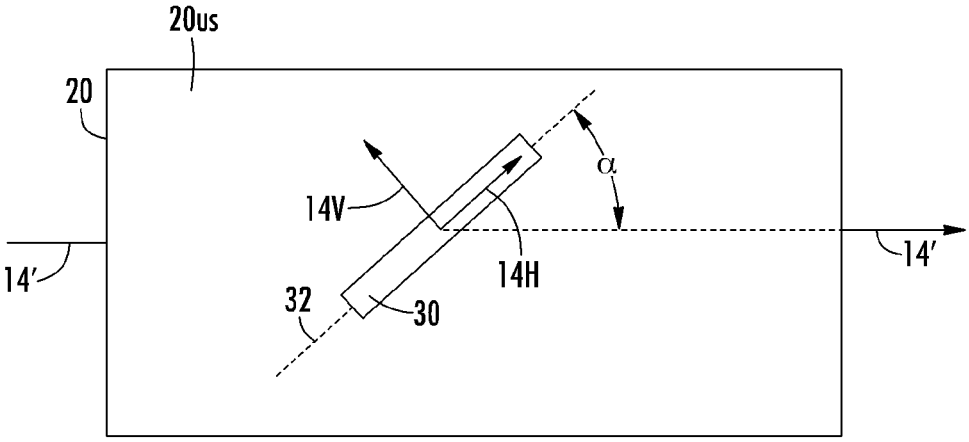
FIG. 1B is a sectional plan view of the arrangement of FIG. 1A.

FIG. 1B is a plan view of the upper surface 20*us* of dielectric slab 20. In FIG. 1B, the direction of the electric field vector 14' is indicated, together with a dash line 32 indicating the direction of elongation of slot 30. The direction of elongation of slot 30 lies at an angle of $\alpha$ relative to direction 14' in a plane parallel with the surface 20*us*. Also in FIG. 1B, two mutually orthogonal components of the linear radiation 14 arriving at dielectric slab 20 are illustrated as 14V and 14H. As mentioned, these are merely identifications, and do not necessarily indicate or relate to the actual orientation of the field components.

Those skilled in the art know that a single set of polarizing slots such as slots 30, 50, and 70 of FIG. 1A will convert polarization, but are ordinarily accompanied by additional slots oriented parallel therewith to improve the polarization conversion efficiency. In FIG. 1B, slot 30 of dielectric slab 20 is seen to lie at a 45° angle relative to the direction of electric field line 14'. The direction of electric field line 14' can be resolved into a first "horizontal" component 14H which lies parallel with the direction of elongation of the slot 30 and a second "vertical" component 14V which lies orthogonal to the direction of elongation of the slot 30.

Figure 2A:
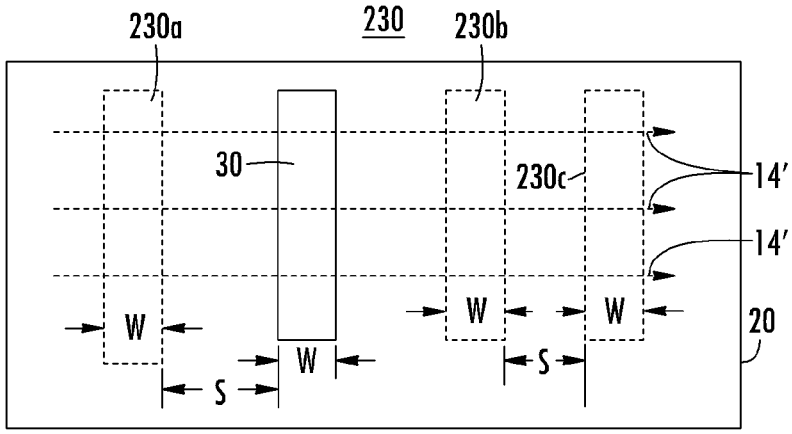
FIG. 2A is a simplified plan view of a dielectric slab of FIG. 1A defining a plurality of mutually parallel through slots, the axes of elongation of which are orthogonal or normal to the direction of the linear vertical component of polarization passing therethrough.

FIG. 2A is a simplified plan representation of a polarizer or phase shifter in the form of a surface of dielectric slab or plate 20, with slot 30 designated, and with additional slots 230*a*,

230*b*, and 230*c* of a set 230 of slots illustrated by dash outlines. The direction of elongation of the slots of set 230 of FIG. 2A is illustrated as being perpendicular to the direction 14' of the linear polarization 14'. In FIG. 2A, the slots of set 230 have a particular width W and a particular inter-slot spacing S. The bulk dielectric material of dielectric slab 20 of FIG. 2A has a relative dielectric constant of $\in_{R20}$. The effective dielectric constant $\in_{rV}$ presented by slotted layer 230 to the electric field represented by arrow 14V will depend upon the width of the slots and their center-to-center spacing.

Figure 2B:
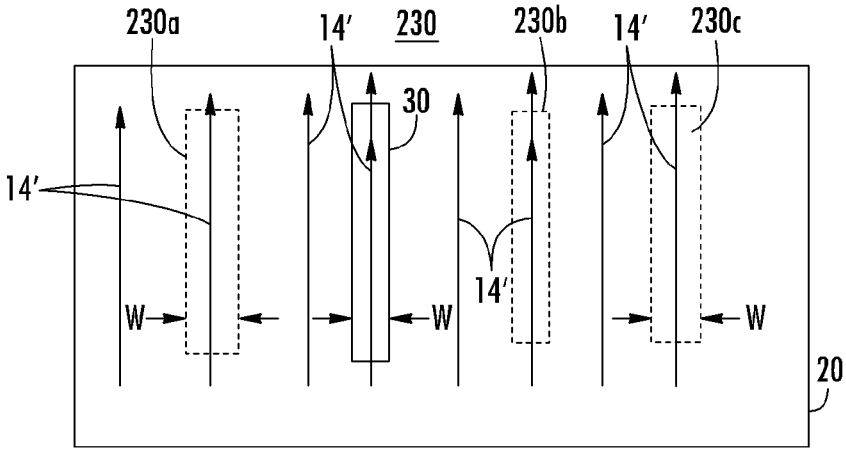
FIG. 2B is a plan view of the same dielectric slab defining a plurality of mutually parallel through slots, the axes of elongation of which are parallel to the direction of the linear horizontal component of polarization.

FIG. 2B is a simplified plan representation of a surface of dielectric slab or plate 20, with slot 30 designated, and with additional slots 230*a*, 230*b*, and 230*c* of set 230 illustrated by dash outlines. The direction of elongation of the slots of set 230 is illustrated as being parallel to the direction 14H of the applied linear polarization. In FIG. 2B, the slots of set 230 have the same width W and a particular inter-slot spacing S. The effective dielectric constant differs as between the parallel 14H and the perpendicular 14V polarization components. It will be clear that the effective parallel relative dielectric constant depends upon the width of the slots and their center-to-center spacing.

Figure 3:
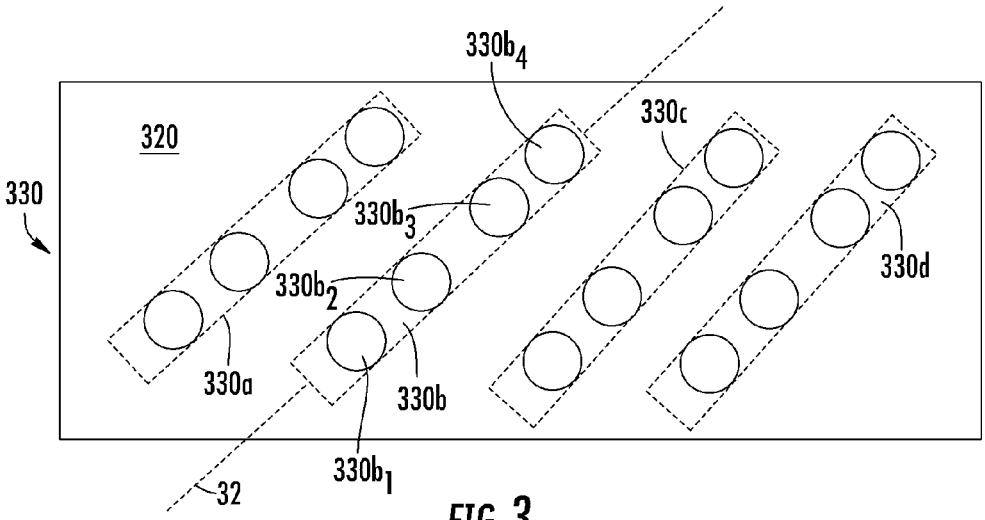
FIG. 3 is a simplified plan view of a dielectric slab with elongated patterns of circular through holes rather than elongated slots as in FIG. 2A.

FIG. 3 illustrates a polarizer or phase shifter including a generally planar slab 320 of dielectric material. A plurality of sets 330 of apertures includes sets 330*a*, 330*b*, 330*c*, and 333*d*. Each set of apertures is illustrated as having four circular through holes. More specifically, set 330*b* of apertures includes apertures 330*b*1, 330*b*2, 330*b*3, and 330*b*4. The only reason that the apertures are circular is that drill bits tend to make circular holes. Other shapes of apertures may be used. The use of separate apertures in each set of apertures tends to retain strength in the slab by comparison with the use of continuous slots, which by definition do not have cross support.

Figure 4:
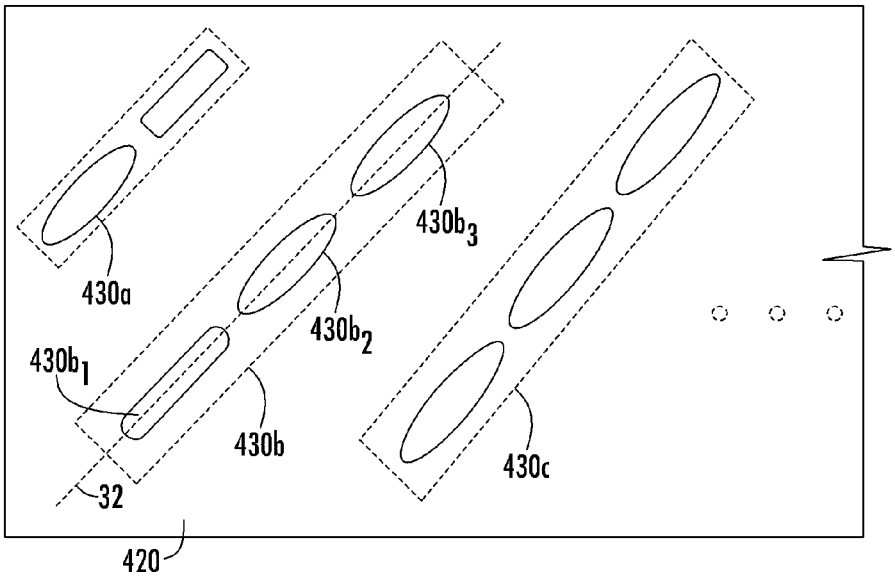
FIG. 4 illustrates in plan view a dielectric slab with a plurality of aperture sets, each of which includes a plurality of mutually coaxial slot apertures.

In one embodiment, each set of apertures comprises a plurality of discontinuous, coaxial slots. FIG. 4 illustrates in plan view a dielectric slab 420 with a plurality of slot aperture sets 430*a*, 430*b*, 430*c*, . . . . More specifically, representative slot set 430*b* includes a set of discontinuous, mutually coaxial slots 430*b*1, 430*b*2, 430*b*3.

Figure 5:
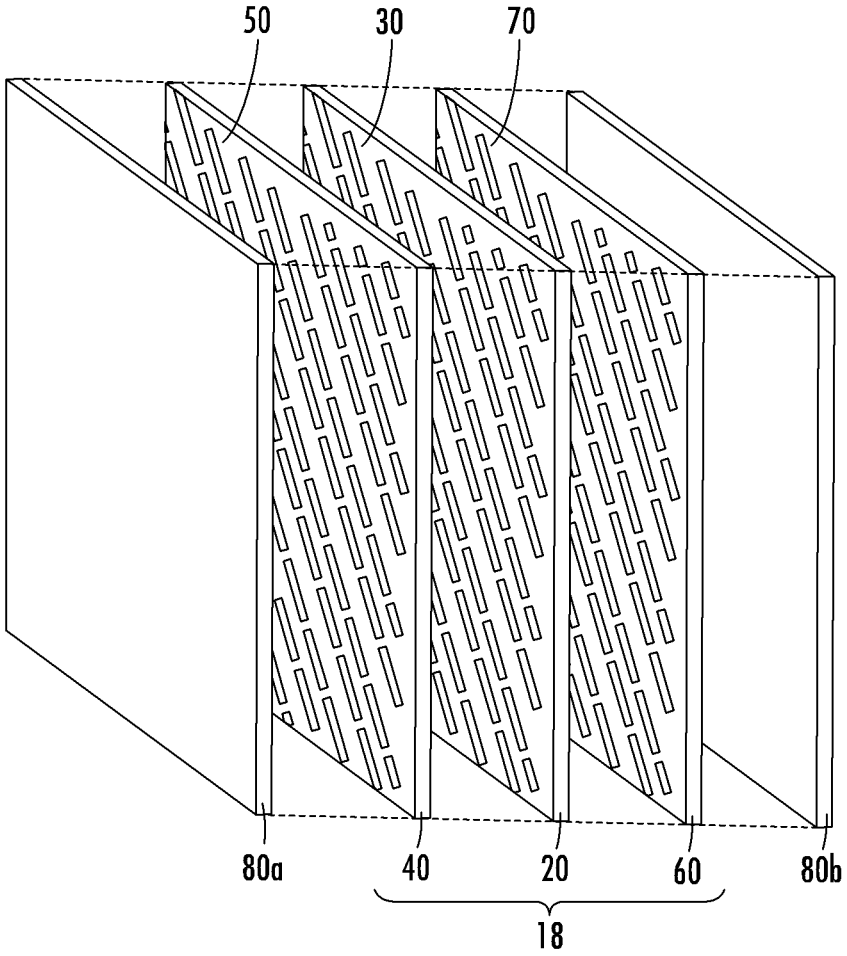
FIG. 5 is a simplified diagram of a polarizer or phase shifter including a plurality of slotted dielectric slabs juxtaposed to provide impedance matching, and also including protective or stiffening sheets of dielectric material.

FIG. 5 is a simplified, exploded view of an exemplary embodiment of a polarizer or phase shifter. Elements of FIG. 5 corresponding to those of FIGS. 1A and 1B are designated by like reference numerals. More particularly, a representative one of the through apertures in dielectric slab 20 of FIG. 5 is a discontinuous slot designated 30. Similarly, representative ones of the discontinuous through apertures in dielectric slabs 40 and 60 of FIG. 5 are slots designated 50 and 70, respectively. Additional dielectric slabs are illustrated as being associated with the exterior of stack 18. More particularly, a non-slotted dielectric slab 80*a* is illustrated as being adjacent to dielectric slab 40 and remote from slab 20, and a further nonslotted dielectric slab 80*b* is illustrated as being adjacent to dielectric slab 60 and remote from slab 20. The additional dielectric slabs 80*a* and 80*b* are stiffening or support slabs. Of course, when the structure of FIG. 5 is assembled into a stack, slabs 80*a* and 80*b* are made into a monolithic whole with slabs 30, 40, and 60. The connection between or among the slabs may be by fusion or by means of an adhesive material such as epoxy. As described in conjunction with the stack 18 of FIG. 1A, many more pierced dielectric slabs may be used than the three illustrated.

The effective dielectric constants of the stacked pierced dielectric slabs of the arrangement of FIG. 5 are selected to reduce or minimize reflections of the electromagnetic waves entering and or leaving the stack. The reduction of reflections is often known as "matching" or "impedance matching" and has the advantage of reducing transmission or path losses attributable to the reflections. This matching may be accomplished by selecting the effective dielectric constant of the center slab of the stack to have a greater value than that of any of the other layers. Put another way, the effective dielectric constants of the pierced dielectric slabs decreases with distance from the center slab (20) of the stack (18). In effect, this creates a step change in impedance between free space and that (or those) dielectric slabs having the greatest values of dielectric constant.

While good matching can be achieved by using many layers of pierced dielectric slabs in the stack, and by selecting very small changes in effective dielectric constant from the center of the stack to the exterior of the stack, there will often be weight and cost constraints on the number of slabs which can be used in the stack. There is also the practical problem of finding sources of dielectric material having small incremental changes in dielectric constant. Even if dielectric sheets having small incremental changes in dielectric constant were readily available, there would remain the problem of forming such sheets into the requisite thin layers without damaging the sheets.

In an embodiment similar to that of FIG. 5, center pierced dielectric slab 20 is made from dielectric with highest constant and provides the greatest part of the 90-degrees phase shift required for achieving circular polarization. The thickness d of slab 20 can be obtained from $$d_{20} = \frac{\Delta\varphi_{20}}{2\pi}\frac{\lambda}{\sqrt{\varepsilon_{effH}^{(20)}} - \sqrt{\varepsilon_{effV}^{(20)}}}$$

and $\Delta\phi_{20}<\pi/2$ is the differential phase shift

The effective dielectric constant of slabs 40 and 60 must theoretically be $$\in_{effH}^{(40)}=\in_{effH}^{(60)}=\sqrt{\in_{effH}^{(20)}}$$

$$\in_{effV}^{(40)}=\in_{effV}^{(60)}=\sqrt{\in_{effV}^{(20)}}$$

The thickness of slabs 40 and 60 should be chosen to match the slab 20 with free space $$d_{40} = d_{60} \approx \frac{\lambda}{8}\left(\frac{1}{\sqrt{\varepsilon_{effH}^{(40)}}} - \frac{1}{\sqrt{\varepsilon_{effV}^{(40)}}}\right)$$

The additional differential phase shift created by the slabs 40 and 60 is much less than from slab 20 and equals $$\Delta\varphi_{40} = \Delta\varphi_{60} \approx \frac{2\pi}{\lambda}\left(\sqrt{\varepsilon_{effH}^{(40)}} - \sqrt{\varepsilon_{effV}^{(40)}}\right)d_{40}$$

Since we need to simultaneously achieve good match and good axial ratio, the final values of all dielectric constants and thicknesses are estimated as a result of parametric optimization using the equation $$\Delta\phi=2\Delta\phi_{40}+\Delta\phi_{20}\approx\pi/2$$

Since the only variable in this equation is the thickness of slab 20, this optimization can be done using a simple calculator. For more precise optimization any of available electromagnetic tools (HFSS, CST, etc.) can be used. For example, the center pierced dielectric slab 20 is made from Arlon AD1000 dielectric material, which has a bulk dielectric constant $\in_R$=10.2, and the two side pierced dielectric slabs 40 and 60 are made from Arlon AD410 material, which has a relative bulk dielectric constant $\in_R$=3.66. The thickness of center slab 20 is 0.065 inches, and the thickness of each side slab 40 and 60 is 0.050 inches. Arlon AD1000 and Arlon AD410 are trade names of Arlon Incorporated company, which is located at 2811 S. Harbor Blvd., Santa Ana, Calif. 92704 and the telephone number of which is 1-800-854-0361. The Arlon layers of dielectric material can be joined to each other along their major or broad surfaces by fusion bonding. The stiffening and environmental protection layers of dielectric 80*a* and 80*b* can each be 250-mil-thick honeycomb panels which also stiffen the assembly while having a relative dielectric constant within the honeycomb which is close to air. The honeycomb panels can be joined to the Arlon layers using a room temperature cured epoxy.

In an embodiment using Arlon and honeycomb dielectric slabs, the slots are 0.762 millimeters (mm) wide, with the same gap between them. The slots are registered from layer to layer.

According to an aspect of the disclosure, the structure of the polarizer or phase shifter of FIG. 5 can be fabricated by a multistep process or method illustrated in conjunction with FIGS. 6A through 6K. The method can begin with the procuring of a sheet of dielectric material with a particular dielectric constant, illustrated as 20 in FIG. 6A. Two sheets of dielectric material of lesser dielectric constant are procured, which are illustrated as 40 and 60. The round shape of the illustrated sheets has no significance. The broad sides or surfaces of sheets 40 and 60 are juxtaposed with the broad sides or surfaces of sheet 20, and then, these surfaces are bonded, as by fusion using heat, pressure, or both. This is equivalent to "sandwiching" the center dielectric sheet 20 between outer dielectric sheets 40 and 60. This results in the monolithic stack 600 of FIG. 6B, having a lower broad surface 401*s* and a broad upper surface 60*us*.

Figure 6A:
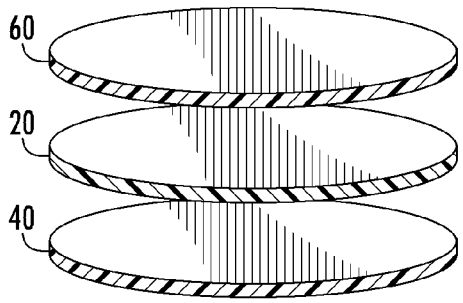
FIG. 6A is a simplified perspective or isometric view of three dielectric sheets, exploded away from each other to emphasize the structure.
Figure 6B:
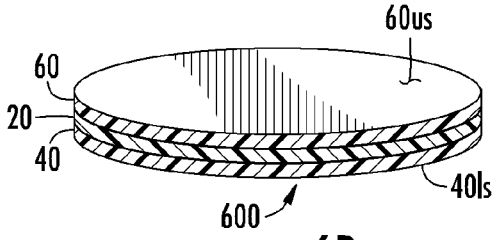
FIG. 6B illustrates the three dielectric sheets of FIG. 6A juxtaposed and joined together to form a monolithic stack.
Figure 6C:
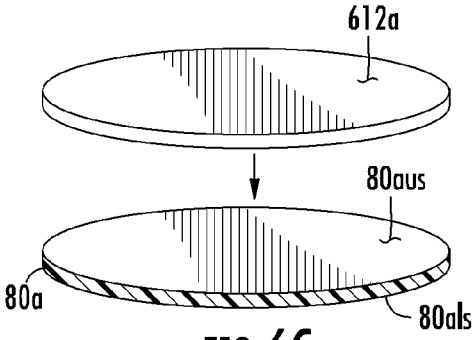
FIG. 6C illustrates the affixing of an adhesive perform to a dielectric support sheet.
Figure 6D:
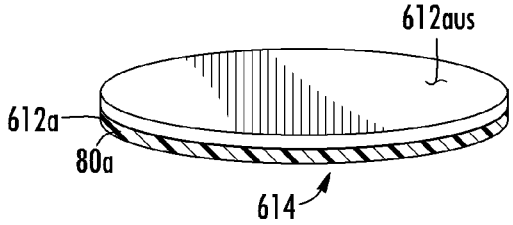
FIG. 6D illustrates the structure resulting from the affixation of FIGURE C.

The next step can be to apply a first adhesive perform 612*a*, such as of uncured epoxy, to a side, such as side 80*aus*, of a reinforcing or supporting dielectric sheet 80*a*, as illustrated in FIG. 6C. Reinforcing or supporting dielectric sheet 80*a* may be a honeycomb dielectric sheet. This results in the support structure 614 of FIG. 6D, with a broad upper side 612*us* of the adhesive perform remote from the reinforcing or supporting sheet 80*a*.

Figure 6E:
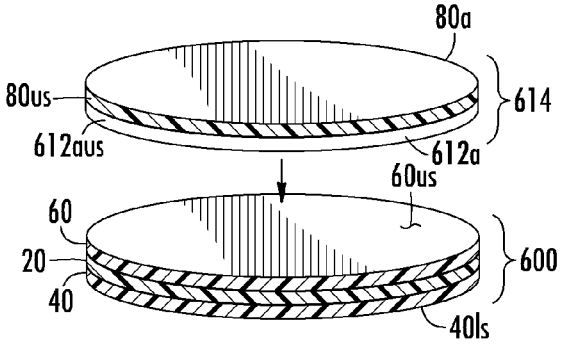
FIG. 6E illustrates the application of the structure of FIG. 6D to the dielectric stack of FIG. 6B.
Figure 6F:
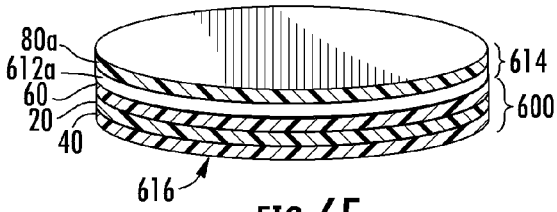
FIG. 6F illustrates the result of the step of FIG. 6E.

The next step can be to bond or otherwise affix the first reinforcing or supporting dielectric sheet 80*a* to the monolithic stack 600 of dielectric sheets, as illustrated in FIG. 6E. That is, the free side (612*aus*) of adhesive perform 612*a* is attached to the upper surface 60*us* of the monolithic dielectric stack 600. The adhesive layer 612*a* is allowed to cure, or made to cure, as by a heating step. The result of this third step is to produce a partially supported stack 616, illustrated in FIG. 6F. Stack 616 illustrates reinforcing or supporting layer 80*a* affixed by adhesive layer 612*a* to a side of dielectric sheet 60. Dielectric sheet 60 is, in turn, bonded to dielectric layer 20. Dielectric layer 20 is, in turn, bonded to dielectric layer 40, so that stack 616 of FIG. 6F is a unitary or monolithic structure.

Figure 6G:
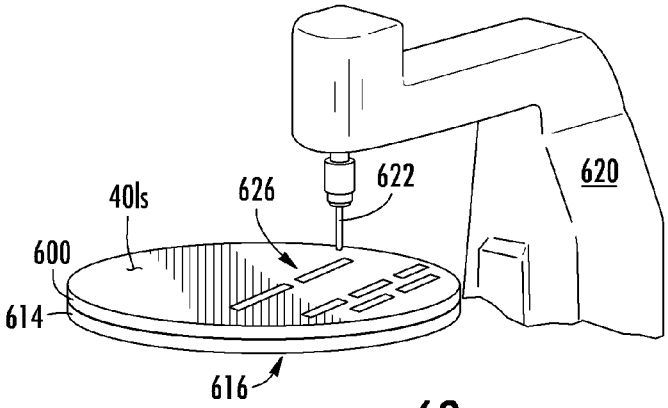
FIG. 6G illustrates the defining of elongated aperture sets in the structure of FIG. 6F.
Figure 6H:
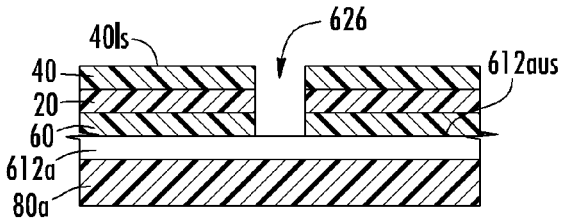
FIG. 6H is a side elevation view of the structure of FIG. 6F with a slot defined therein.

The next step, as illustrated in FIG. 6G, can be to mount the partially supported stack 616 in a milling or equivalent machine 620 with the free surface 401*s* facing the mill 622. Elongated slots or equivalent apertures are defined through the monolithic stack 600, nominally to a depth which just contacts the adhesive perform 612*a*. Since the layer of adhesive is thin, the slots or grooves may actually cut through the adhesive layer 612*a*. FIG. 6H is an elevation (side) cross-section illustrating the result of milling a slot 626 from upper surface 401*s* of dielectric sheet 40, through dielectric sheets 20 and 60, to the depth of surface 612*aus* of adhesive or epoxy 612*a*. Of course, many mutually parallel grooves, slots or slot equivalents are made, rather than just one as illustrated. Those skilled in the art know how to operate a mill or equivalent tool to make grooves, slots or slot equivalents to a particular depth. A particular advantage of this method is that the milling step is performed on a dielectric stack which is at least partially supported by the support sheet, so is less liable to be damaged than if the milling were to be performed on an unsupported stack such as stack 600 of FIG. 6B, and the milling cutter does not come near a baseplate of the milling machine, so cannot impinge thereon.

Figure 6I:
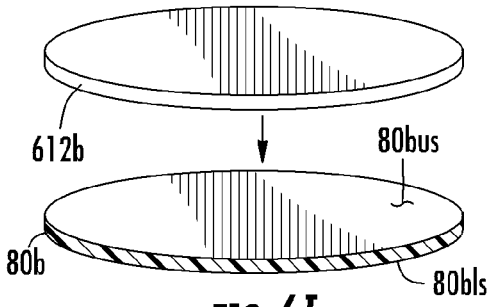
FIGS. 6I and 6J illustrate the application of an adhesive perform to a support or reinforcing sheet and the resulting structure, respectively.

FIG. 6I illustrates another step in making a polarizer, which can be to apply a further adhesive preform 612*b* to a second dielectric support sheet 80*b*. Second dielectric support sheet 80*b* may have a honeycomb structure. The resulting second support sheet 624 with adhesive 612*b* on a first side 80*bus* of the second support sheet 80*b* is illustrated in FIG. 6J.

Figure 6J:
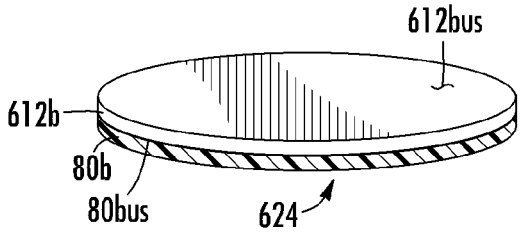
Figure 6K:
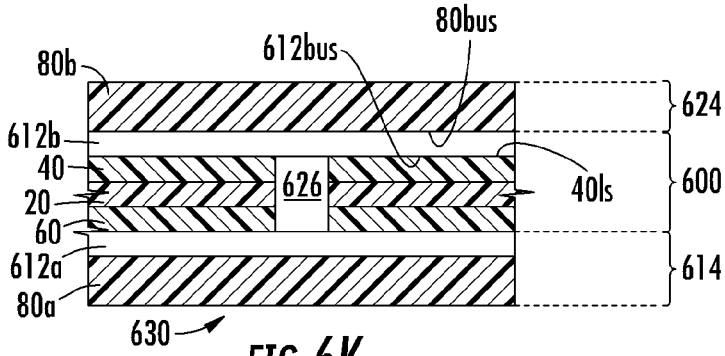
FIG. 6K is a side elevation view of the fully supported dielectric stack with an aperture or slot.

The final step in fabricating a fully supported slotted dielectric stack, illustrated in FIG. 6K, can be to apply the adhesive preform 612*b* of the second support structure 624 of FIG. 6J, to the slotted surface 401*s* of monolithic dielectric stack 600 to form the fully supported structure 630 of FIG. 6K.

In the fabrication of the supported stack of dielectric sheets, stack 600 of dielectric sheets or slabs are arranged with dielectric constants distributed with the slabs 40 and 60 of lowest effective dielectric constants on the outside of the stack and the highest effective dielectric constant slab 20 at or near the center of the stack. The juxtaposed broad surfaces of the layers are fused, as by use of heat. The Arlon materials surface fuse at temperatures of about 300°.

Figure 7:
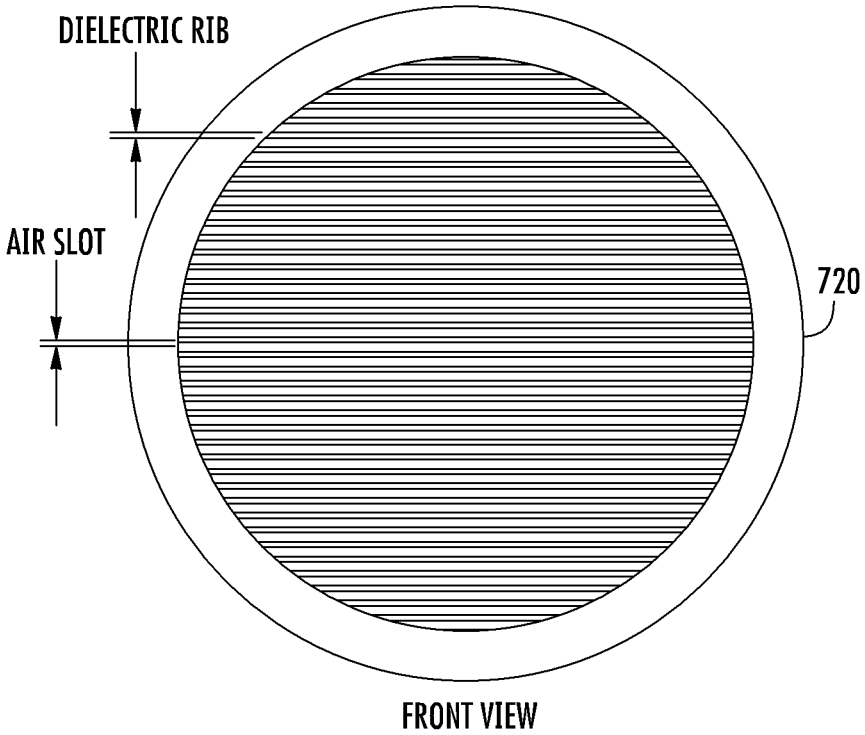
FIG. 7 is a plan view of a slotted single layer or slab of dielectric which may be used either as a polarizer or as a matching/polarizing slab.

FIG. 7 is a plan view of a slotted dielectric slab 720 with a certain bulk dielectric constant $\in_R$ and certain effective dielectric constant $\in_{eff}$. A plane wave impinging parallel upon the dielectric slab reflects by the reflection coefficient $$|\Gamma|^2 = \left|\frac{\sqrt{\varepsilon_{eff}} - 1}{\sqrt{\varepsilon_{eff}} + 1}\right|^2 \tag{3}$$

The corresponding mismatching loss attributable to mismatch is given by $$10 \log_{10}(1-|\Gamma|^2) \tag{4}$$

Since the effective dielectric constant depends upon polarization (vertical or horizontal) the reflection coefficient also depends upon polarization. In this case, we can simultaneously provide matching for both polarizations.

Figure 8:
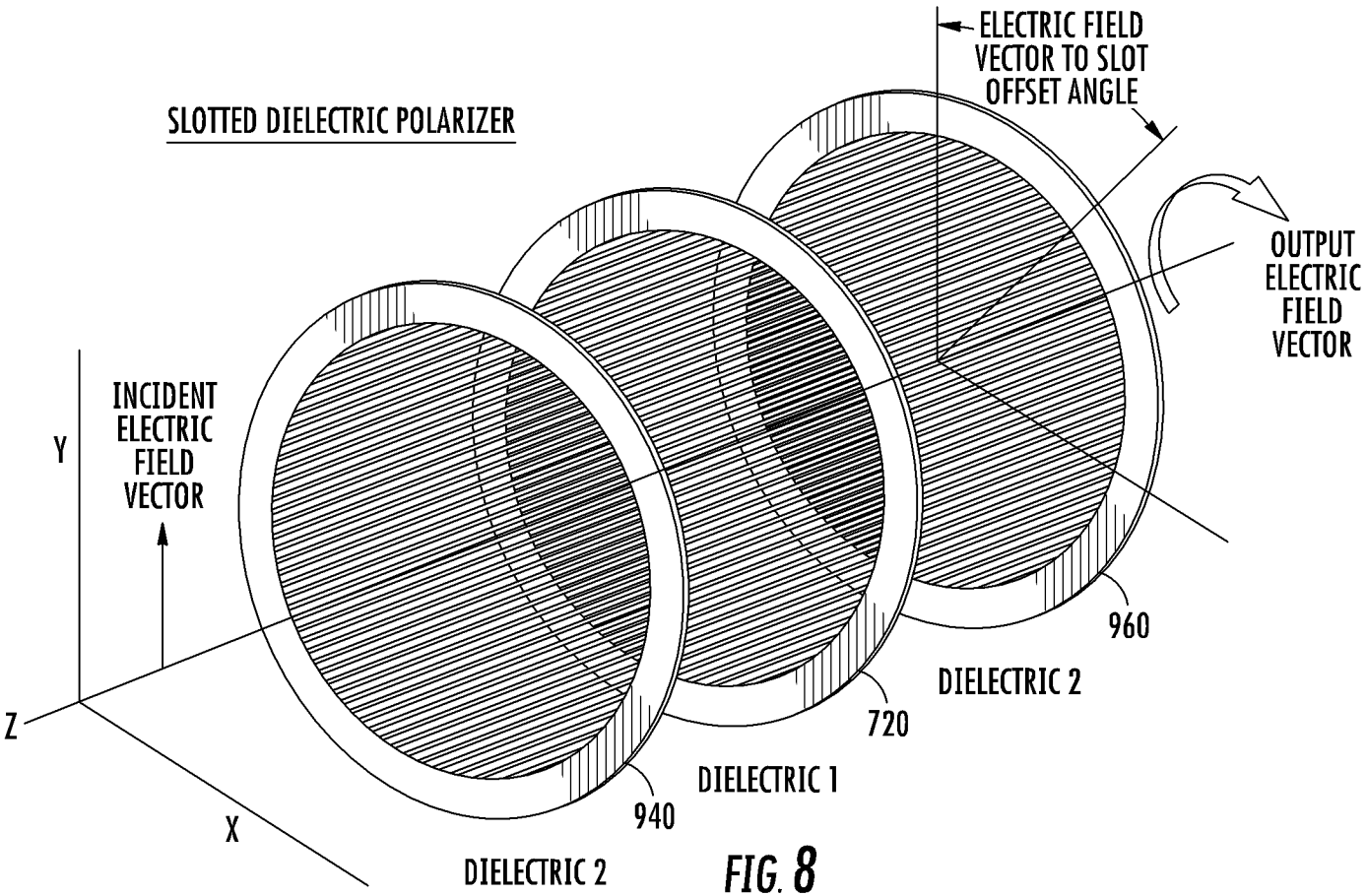
FIG. 8 is a simplified exploded view of a matched polarizer fabricated according to an aspect of the disclosure, including the polarizer of FIG. 7 and slotted matching layers.

If the slab 720 of FIG. 7 were to be used as a polarizer, without matching elements, with bulk dielectric constant $\in$=10.2, and with vertical effective dielectric constant of about 1.81 and horizontal effective dielectric constant of about 6.15 as illustrated in FIGS. 8A and 8B, respectively, the vertical-polarization reflected power proportional to $|\Gamma|_v^2$ would be 0.14725 and the horizontal-polarization reflection power proportional to $|\Gamma|_H^2$ would be 0.42560. The corresponding vertical insertion loss attributable to reflection would be 0.69 dB and the parallel insertion loss would be 2.41 dB. These differences affect the magnitudes of the H and V components leaving the polarizer to cause a difference of about 2 dB. This difference is enough to result in substantial noncircularity of the circular polarization.

In an exemplary embodiment, matching layers are used to reduce the insertion loss attributable to mismatch. FIG. 9 is a simplified representation of a matched polarizer, exploded to reveal the relationship of the layers. In FIG. 9, the structure includes a slotted central "polarizer" dielectric slab 720 of a first dielectric material (dielectric 1), sandwiched between second and third slotted "matching" dielectric slabs 940, 960, of a second dielectric material (dielectric 2). As illustrated, and in conformance with FIG. 1A, the slots are registered with each other. In an exemplary embodiment, the bulk dielectric constant of the polarizer material (dielectric 1) is selected to be 10.2, and the bulk dielectric constant of the matching dielectric (dielectric 2) is selected to be 3.66. The spacing between slots is 0.762 millimeters (mm) and the width of the slots is also 0.762 mm, corresponding to the dimensions associated with the polarizer 720 of FIG. 7. The effective perpendicular or vertical dielectric constant $\in_{effV}$ of a slotted outer matching layer 940 or 960 is about 1.59 as illustrated in FIG. 10A, and the parallel or horizontal dielectric constant $\in_{effH}$ of each slotted outer layer is about 2.38. In order to match free space ($\in_R$=1) to the center polarizer 720, the outer or matching layer must have an approximate thickness of $$\frac{\lambda_0}{\sqrt[4]{\varepsilon_{eff}}}$$

In order to maintain approximately 90 degrees of phase shift between the parallel and perpendicular polarizations, the thickness of the center or polarizing layer is determined by numerical optimization of the phase shift as a function of thickness.

The theoretical values for perfect match of the polarizer is sqrt (1.81)=1.34 for normal polarization, and sqrt (6.16)=2.48 for parallel polarization. In practice, perfect match is difficult to achieve, but an actual embodiment for use at millimeter wave bands gave values of 1.59 and 2.38, respectively. This reduces the insertion loss to about 0.2 dB from an estimated 1.0 dB for the polarizer alone. Put another way, the improvement in insertion loss is estimated to be by a factor of five by comparison with an equivalent meander-line polarizer.

A method according to an aspect of the disclosure is for fabricating a dielectric polarizer or phase shifter according to an aspect of the disclosure comprises the step of sandwiching a sheet (20) of dielectric material exhibiting a first dielectric constant between a pair of sheets (40, 60) of dielectric material exhibiting a second dielectric constant, different from the first dielectric constant, and joining the sheets to thereby make a monolithic stack (600) defining first (401*s*) and second (60*us*) broad surfaces. The joining of the sheets of the stack may be fusion by heat, pressure, or both. In one mode of the method, the first dielectric constant is greater than the second dielectric constant. The method also includes the step of sandwiching a first adhesive preform (612*a*) between a first dielectric support sheet (80*a*) and the second broad surface (60*us*) of the monolithic stack (600), to thereby define a partially supported stack (616) with an exposed first (401*s*) broad surface. Mutually parallel slots, grooves or groove-like depressions (320, 626) are defined in the exposed second broad surface (401*s*) of the partially supported stack (616), nominally to the depth of the first adhesive perform (612*a*). A second adhesive perform (612*b*) is sandwiched between a second dielectric support sheet (80*b*) and the slotted or grooved second broad surface (401*s*) of the partially supported stack (616) to thereby define a fully supported stack (630) phase shifter. In another mode of the method, the first and second adhesives are cured or allowed to cure. The step of sandwiching a sheet (20) of dielectric material exhibiting a first dielectric constant between a pair of sheets (40, 60) of dielectric material exhibiting a second dielectric constant, different from the first dielectric constant, and joining the sheets to thereby make a monolithic stack (600) defining first (401*s*) and second (60*us*) broad surfaces, may comprise the step of sandwiching a sheet (20) of dielectric material exhibiting a first dielectric constant between a pair of sheets (40, 60) of dielectric material exhibiting a second dielectric constant, less than that of the first dielectric constant, and joining the sheets to thereby make a monolithic stack (600) defining first (401*s*) and second (60*us*) broad surfaces.

A method according to another aspect of the disclosure is for making a polarizer or phase shifter for electromagnetic energy, and comprises the step of stacking a plurality (three) of generally planar dielectric sheets (20, 40, 60 of FIG. 6A) to produce a stack (600) of dielectric sheets, with those dielectric sheets toward the center of the stack (600) being selected to have a greater dielectric constant than those dielectric sheets toward the outside of the stack (600). The mutually adjacent surfaces of the stack of dielectric sheets are joined to thereby generate a unitary stack structure (600 of FIG. 6B) defining first (60*us*) and second (401*s*) broad sides. A layer of adhesive (612*a* of FIG. 6C), which may be a preform, is applied to a first broad side (80*aus*) of a first dielectric support sheet (80*a*), to thereby generate a first support sheet (614 of FIG. 6D) with adhesive (612*a*) on a first side (80*us*). The adhesive (612*a*) on the first side (80*us*) of the first support sheet (614) is affixed to the first broad side (60*us*) of the unitary stack structure, to thereby generate a partially supported stack (616) including the unitary stack structure (600), the first support sheet (80*a*), and a layer (612*a*) of adhesive connecting the first support sheet (80*a*) to the first broad (60*aus*) side of the unitary stack structure (600). Slots, grooves or groove-like depressions (320, 626), which may be mutually parallel, are defined in the exposed second broad surface (401*s*) of the partially supported stack (616), nominally to the depth of the first adhesive preform (612*a*). A layer of adhesive (612*b* of FIG. 6I) is applied to a first broad side (80*bus*) of a second dielectric support sheet (80*b*), to thereby generate a second support sheet (624 of FIG. 6J) with adhesive (612*b*) on a first side (80*bus*). The adhesive (612*b*) on the first side (80*bus*) of the second support sheet (624) is affixed to that side (401*s*) of the exposed second broad surface (401*s*) of the partially supported stack (616) exhibiting the slots, grooves or groove-like depressions (320, 626). The adhesive is cured or allowed to cure. The step of joining the mutually adjacent surfaces of the stack of dielectric sheets to thereby generate a unitary stack structure (600 of FIG. 6B) comprises the step of fusing or bonding the mutually adjacent surfaces of the stack of dielectric sheets, as by heat, pressure, or both. The preform may be made by the steps of cutting a sheet of uncured epoxy to the dimensions of either the stack of dielectric sheets or of the support sheet.

What is claimed is:

1. A method for fabricating a dielectric polarizer or phase shifter, the method comprising the steps of:

sandwiching a sheet of dielectric material exhibiting a first dielectric constant between a pair of sheets of dielectric material exhibiting a second dielectric constant, different from said first dielectric constant, to form a monolithic stack defining first and second surfaces;

sandwiching a first adhesive preform between a first dielectric support sheet and said first surface of said monolithic stack, to form a partially supported stack;

defining slots, grooves or groove-like depressions in the second surface of the partially supported stack, nominally to the depth of the first adhesive preform; and sandwiching a second adhesive preform between a second dielectric support sheet and the slotted or grooved second surface of the partially supported stack to define a fully supported stack.

2. A method according to claim 1, wherein said first and second adhesives are cured or allowed to cure.

3. A method according to claim 1, further comprising the step of joining the sheet of dielectric material exhibiting the first dielectric constant with the pair of sheets of dielectric material exhibiting a second dielectric constant, different from said first dielectric constant.

4. A method according to claim 3, wherein said joining step is performed by fusion bonding the sheets by heat, pressure, or both.

5. A method according to claim 1, wherein said defining step is performed so that said slots, grooves or groove-like depressions are parallel to one another.

6. A method for making a phase shifter for electromagnetic energy, said method comprising the steps of:

stacking a plurality of generally planar dielectric sheets to produce a stack of dielectric sheets, with those dielectric sheets toward the center of said stack being selected to have a greater dielectric constant than those dielectric sheets toward the outside of said stack to form a unitary stack structure defining first and second sides;

applying a first layer of adhesive to a first side of a first dielectric support sheet;

affixing said first layer of adhesive on said first side of said first support sheet to said first side of said unitary stack structure forming a partially supported stack;

defining slots, grooves or groove-like depressions in the second surface of said partially supported stack, nominally to the depth of the first adhesive layer;

applying a second layer of adhesive to a first side of a second dielectric support sheet; and affixing said second layer of adhesive on said first side of said second support sheet to the second side of said partially supported stack having said slots, grooves or groove-like depressions.

7. A method according to claim 6, further comprising the step of curing said adhesive, or allowing said adhesive to cure.

8. A method according to claim 6, wherein said step of applying a layer of adhesive to said first side of one of said first and second dielectric support sheets, includes the steps of:

generating an adhesive preform; and applying said adhesive preform to said first side of said one of said first and second dielectric support sheet.

9. A method according to claim 8, wherein said step of generating an adhesive preform includes the steps of cutting a sheet of uncured epoxy to the dimension of one of the first dielectric support sheet, the second dielectric support sheet, and the stack of dielectric sheets.

10. A method according to claim 6, further comprising the step of joining the mutually adjacent surfaces of said stack of dielectric sheets to form a unitary stack structure defining first and second sides.

11. A method according to claim 10, wherein said step of joining is performed by fusion bonding said stack of dielectric sheets by heat, pressure, or both.

12. A method according to claim 6, wherein said defining step is performed so that said slots, grooves or groove-like depressions are parallel to one another.

* * * * *